US007845021B2

(12) United States Patent
del Carmen Erana Ahumada

(10) Patent No.: US 7,845,021 B2
(45) Date of Patent: Dec. 7, 2010

(54) GARMENTS IN ORDER TO LIFT THE BUTTOCKS

(76) Inventor: Elisa del Carmen Erana Ahumada, Jalapa No. 185, Col. Roma, Delelegacion Cuauhtemoc, C.P. 06700, Mexico D.F. (MX)

( * ) Notice: Subject to any disclaimer, the term of this patent is extended or adjusted under 35 U.S.C. 154(b) by 500 days.

(21) Appl. No.: 11/884,183

(22) PCT Filed: Feb. 23, 2006

(86) PCT No.: PCT/MX2006/000014

§ 371 (c)(1),
(2), (4) Date: Aug. 10, 2007

(87) PCT Pub. No.: WO2006/091065

PCT Pub. Date: Aug. 31, 2006

(65) Prior Publication Data

US 2008/0271226 A1 Nov. 6, 2008

(30) Foreign Application Priority Data

Feb. 24, 2005 (MX) ..... PA/A/2005/002145

(51) Int. Cl.
*A41D 1/06* (2006.01)
*A41D 13/02* (2006.01)

(52) U.S. Cl. ..... 2/227; 2/238; 2/228

(58) Field of Classification Search ..... 2/227, 2/228, 238, 243.1
See application file for complete search history.

(56) References Cited

U.S. PATENT DOCUMENTS 237,004 A 1/1881 Ferriss
478,195 A * 7/1892 Lewis et al. ..... 2/227
707,558 A * 8/1902 Dane ..... 2/110
2,079,398 A * 5/1937 Dean ..... 2/227
2,306,514 A * 12/1942 Wilker et al. ..... 2/227
2,311,871 A * 2/1943 Riepen ..... 2/227
2,753,567 A * 7/1956 Brice ..... 2/227
3,143,741 A * 8/1964 Tyroler ..... 2/227

(Continued)

FOREIGN PATENT DOCUMENTS

DE 20021413 UI 7/2001

(Continued)

*Primary Examiner*—Gloria Hale
(74) *Attorney, Agent, or Firm*—Jackson Walker, LLP

(57) ABSTRACT

The invention relates to a garment which is intended for the lower part of the body, such as trousers or shorts that are fitted to the waist or hip, which lifts the user's gluteal region in order to improve the appearance thereof while simultaneously providing a high degree of comfort. For said purpose, each of the rear sections of the garment is equipped with: a plurality of built-in clips which extend approximately from the centre of a reinforcing line close to the upper edge of the garment towards the centre of the corresponding buttock; and a plurality of built-in clips which extend from the seam between the rear section and the respective front section, which are disposed in line with the gluteal region and which extend towards the centre of the corresponding buttock. The contour of the aforementioned sections comprises a pronounced outward curve in the join therebetween, such as, when joined, to form a pocket which receives, contains and gives shape to the user's fat and muscular mass, thereby providing the user's figure with the desired effect.

6 Claims, 3 Drawing Sheets

U.S. PATENT DOCUMENTS

| | | | | | |
|---|---|---|---|---|---|
| 3,323,140 | A | * | 6/1967 | Morris | 2/227 |
| 3,745,589 | A | * | 7/1973 | Borsing | 2/227 |
| 3,996,622 | A | | 12/1976 | Cooke | |
| 4,392,259 | A | | 7/1983 | Bredo | |
| 4,392,759 | A | * | 7/1983 | Cook | 403/11 |
| 5,031,326 | A | | 7/1991 | Huang | |
| 5,535,451 | A | * | 7/1996 | Tassone et al. | 2/227 |
| 5,678,250 | A | * | 10/1997 | Nolan | 2/227 |
| 6,311,333 | B1 | * | 11/2001 | Batra | 2/237 |
| 6,336,225 | B1 | | 1/2002 | Bowlby | |
| 6,543,062 | B1 | | 4/2003 | Amsel | |
| 2004/0237173 | A1 | | 12/2004 | Villalobos | |

FOREIGN PATENT DOCUMENTS

| | | | |
|---|---|---|---|
| DE | 20304997 | UI | 5/2003 |
| ES | 169359 | U | 11/1971 |
| GB | 191305777 | A | 1/1914 |
| GB | 369384 | A | 3/1932 |
| JP | 9149959 | A | 6/1997 |
| JP | 2001089916 | A | 4/2001 |

* cited by examiner

GARMENTS IN ORDER TO LIFT THE BUTTOCKS

TECHNICAL FIELD

The current invention relates to garments worn on the lower part of the body, such as pants or shorts, and especially garments that include a series of characteristics that are applied in the manufacturing process, which lifts the user's buttocks in order to improve his or her appearance while offering a high degree of comfort.

BACKGROUND ART

The use of various alternatives to improve the posture or appearance of certain parts of the body, especially the gluteal region, is well known by people involved in the art of manufacturing garments. Most are based on two techniques: a) the use of pleats with seams (also known as 'crimps') to modify the profile of said garments, and b) the inclusion of support bands that 'lift' and at times 'separate' the muscles.

Regarding the first alternative, in many cases, the crimps are designed so that the net effect is, on the one hand, an imprint on the waist and, on the other hand, the elevation of the gluteal region, at the expense of the user's comfort, and in some cases causing discomfort in the crotch area, especially in female users.

The method used to create these pleats in the cloth to improve the figure is described, for example, in U.S. Pat. No. 3,234,947 (Bergstein, 1966), although in this case the purpose of the pleats or crimps is only to modify the appearance without acting directly upon the body of the user.

The use of elastic bands has been the most frequently used alternative. A considerable number of patent documents describe alternate approaches; including, for example, the following:

U.S. design patent No. D453,604 (Hart, 2002) describes a support device for the buttocks, consisting of a band that surrounds the waist, to which are added another two bands that surround the upper part of the user's legs, from the waist, passing under the buttocks towards the crotch and rising again to the waist. The use of narrow bands for exerting pressure on the muscles, will make them "dig in" and offer a disagreeable appearance, as well as discomfort for the user.

The use of wider bands may be a slightly less uncomfortable way to exert pressure on the muscles, as is shown in U.S. Pat. No. 5,888,118 (Kishi, 1999), which employs bands of combined woven materials, with various modules of elasticity, depending on the direction of stretching of the base cloth of the garment, in order to achieve an effect of raising the buttocks and flattening the belly. A similar development is proposed in European patent application No. 2,745,473 (WACOAL CORP., 1997), and, in general, is the basis for the manufacture of various models of girdles. In an alternative sense, U.S. Pat. No. 4,325,379 (Ozbey, 1982) shows the use of elastic bands not only for raising the buttocks but also for exercising them.

U.S. Pat. No. 6,543,062 B1 (Amsel et al., 2003) on the other hand, describes a pair of pants shaped with a high rear and a low front, including elastic panels in the entire front section in order to press the stomach and the user's abdominal area while pulling the rear of the pants in order to lift the buttocks; an attempt is made to ensure an invisible seam, preferentially directed inside the legs and the crotch to offer a smoother appearance.

Finally, U.S. Pat. No. 5,535,451 (Tassone et al., 1996) describes the use of an adjustable "stretch" material for creating a pair of pants using two pieces for the front and rear of the pants, as is well known in the art; the rear sections are attached from the crotch to the waist along an outline seam with a very noticeable roundness, and the legs narrow near the crotch so that the pressure that is exercised causes a rising pressure and therefore the lifting of the gluteal region, so that it molds into the rounded profile of the pants while avoiding the vertical "drop" of the buttocks.

Normally, the effect of these cuts and seams in the crotch area is discomfort for the users, especially females. Devices have been developed to avoid that effect, as U.S. Pat. Nos. 4,5811,771 (Williams, 1986) and 6,681,407 (Martz, 2004) illustrate. These patents describe devices that are placed between the user's body and the garment so as to prevent the seams from rising and are situated between the labia of the vagina.

DISCLOSURE OF INVENTION

Considering the problems in this technical field, the invention must achieve the following objectives:

One objective of the current invention is to provide a garment such as a pair of pants or shorts that supports and shapes the user's buttocks.

Another objective of the current invention is to provide pants that enhance the user's figure without the use of elastic bands of any kind.

Still another objective of the current invention is to provide pants that enhance the user's figure, with characteristics that afford greater comfort to the user without detracting from the ability of the pants to provide support.

These and other objectives shall be evident in light of the following description, which details the characteristics of the current invention that make it different from current alternatives of the technical state of the art.

BRIEF DESCRIPTION OF DRAWINGS

To better understand the description of the current invention, it must be read in conjunction with the drawings that are attached hereto, which illustrate a preferred mode of the invention, and in which all similar elements share the same numeric reference.

DETAILED DESCRIPTION OF THE INVENTION

The purpose of the current invention is to overcome various problems that persist in the technique by incorporating in a pair of pants a series of characteristics that improve the user's appearance by naturally lifting the gluteal region. For a better understanding of the details that characterize the garment of the invention, our description will focus on a pair of pants that includes all of them, and corresponds to one of the rear sections of the pants, which are symmetrical with one another.

Figure 1:
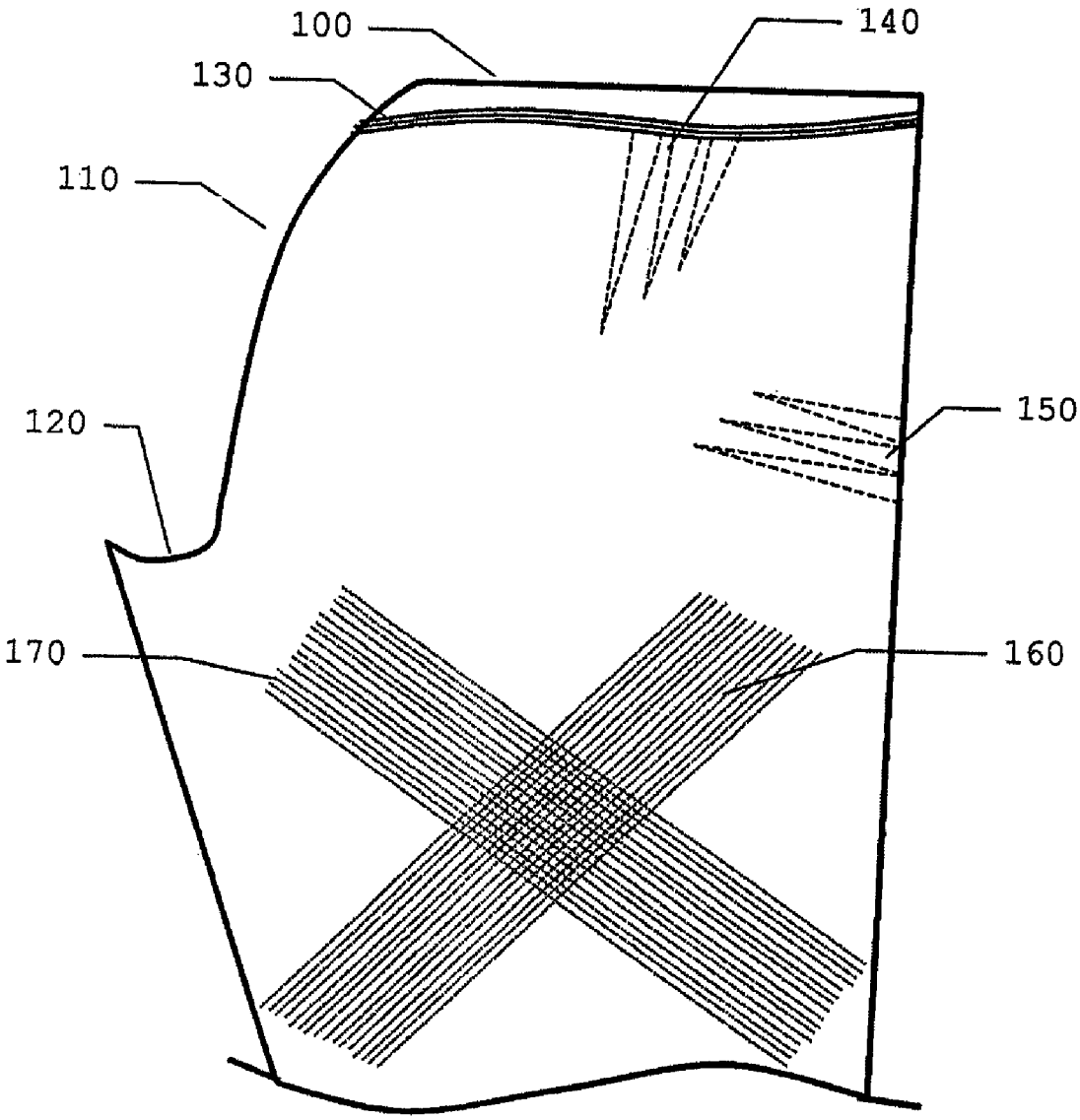
FIG. 1 is a view of the upper plane of the right rear section of a type of garment that includes the characteristics of the invention, either as a pair of pants or shorts.
Figure 2:
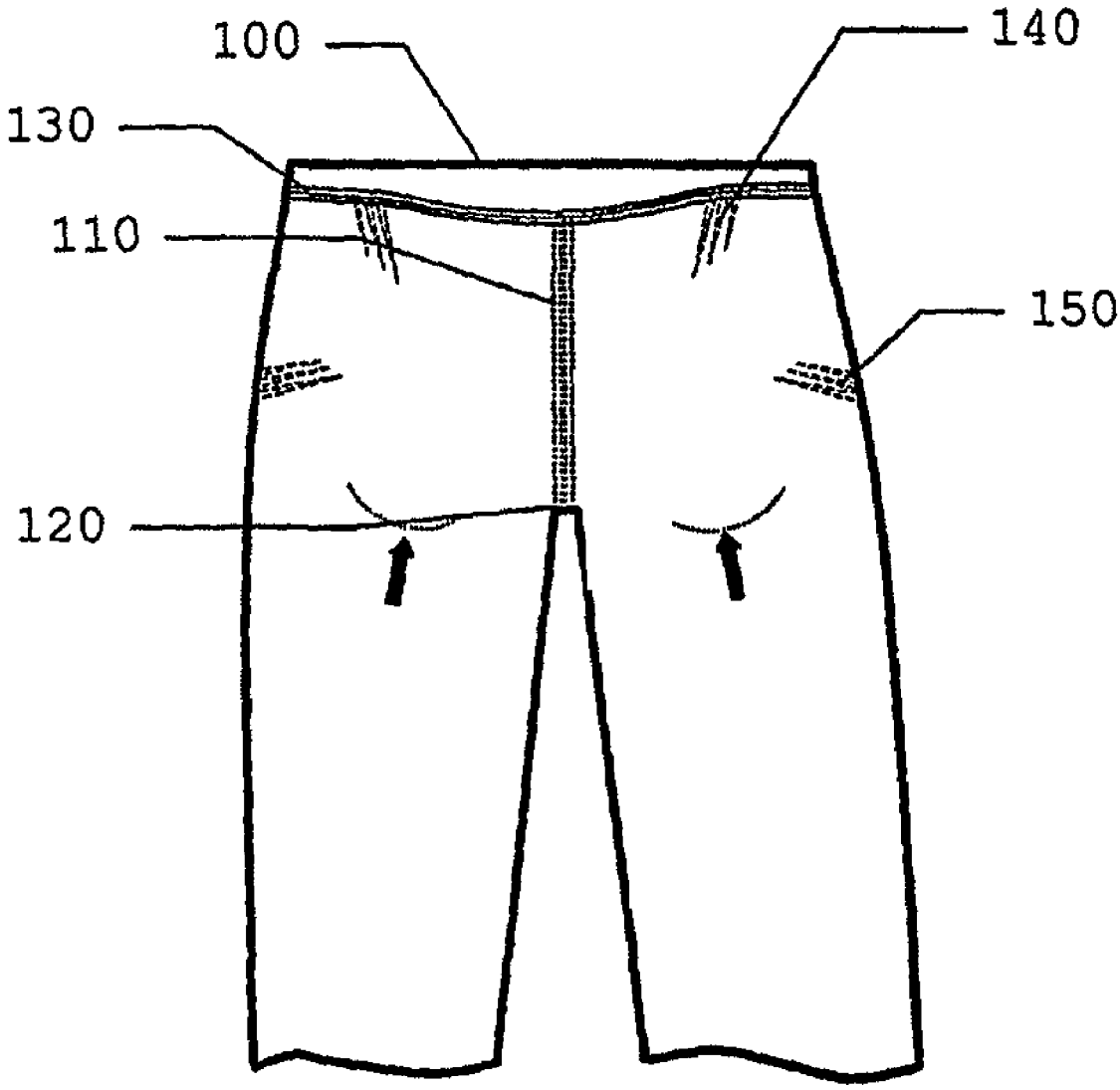
FIG. 2 is a rear view of a type of garment that includes the characteristics of the invention.

FIG. 1 illustrates the right rear section (100) of a model of the garment of the invention, which clearly shows that the outline and other elements have been modified in relation to those that conventionally appear in a rear section of a garment of prior art. The following are the main modifications:

a) The seam (110) that corresponds to the region between the buttocks presents an outwards curvature that is more pronounced than in conventional models of pants, which allows a hand, offering more room for the muscle and fat of the user's gluteal region and, on the other hand, a more comfortable fit of the garment's cloth with a rounder shape in the area next to the seam between the user's buttocks, pushing said seam slightly towards the interior between the buttocks.

b) The part of the inseam (120) that corresponds to the crotch area also presents a more pronounced curve than the conventional models of prior art, which reduces the tendency of the seam to rise in the crotch area, decreasing discomfort from friction when the user performs exercises such as walking or bending; this, in turn, avoids the use of the devices that were cited in the Background Art section, the purpose of which is to protect the vaginal area or crotch.

c) Near the upper edge of the pants, which may be designed to fit at the user's waist or hip, there is a reinforcement stitch (130) (or a series of parallel reinforcement stitches in the mode illustrated in the drawing) that creates a curve that surrounds the gluteal region. This curvature decreases towards the middle of the rear section (100) and changes curvature, although less pronouncedly as it moves towards the seam with the right front section (not illustrated), so that the distance from the upper edge of the rear section (100) towards the reinforcement stitch (130) is greater in the seam of the rear sections than in the seam with the respective front sections.

d) A plurality of "crimps" (140) that begin in the reinforcement stitch (130) and are oriented towards the center of the gluteal region; said "crimps" number one or more, mainly as a function of the reinforcement the cloth is considered to need, but also considering the overall appearance of the pants.

e) A plurality of "crimps" (150) that begin in the seam with the corresponding front section, approximately at a height corresponding to the midpoint of the buttock and oriented towards its center; there may be one or more "crimps," mainly as a function of the reinforcement the cloth is considered to need, but also considering the overall appearance of the pants.

f) The cloth used to manufacture the garment preferably aligns its weft and warp threads approximately in the directions indicated by the stitches (160) and (170), inclined in relation to the vertical seam when the garment is in use.

Figure 3:
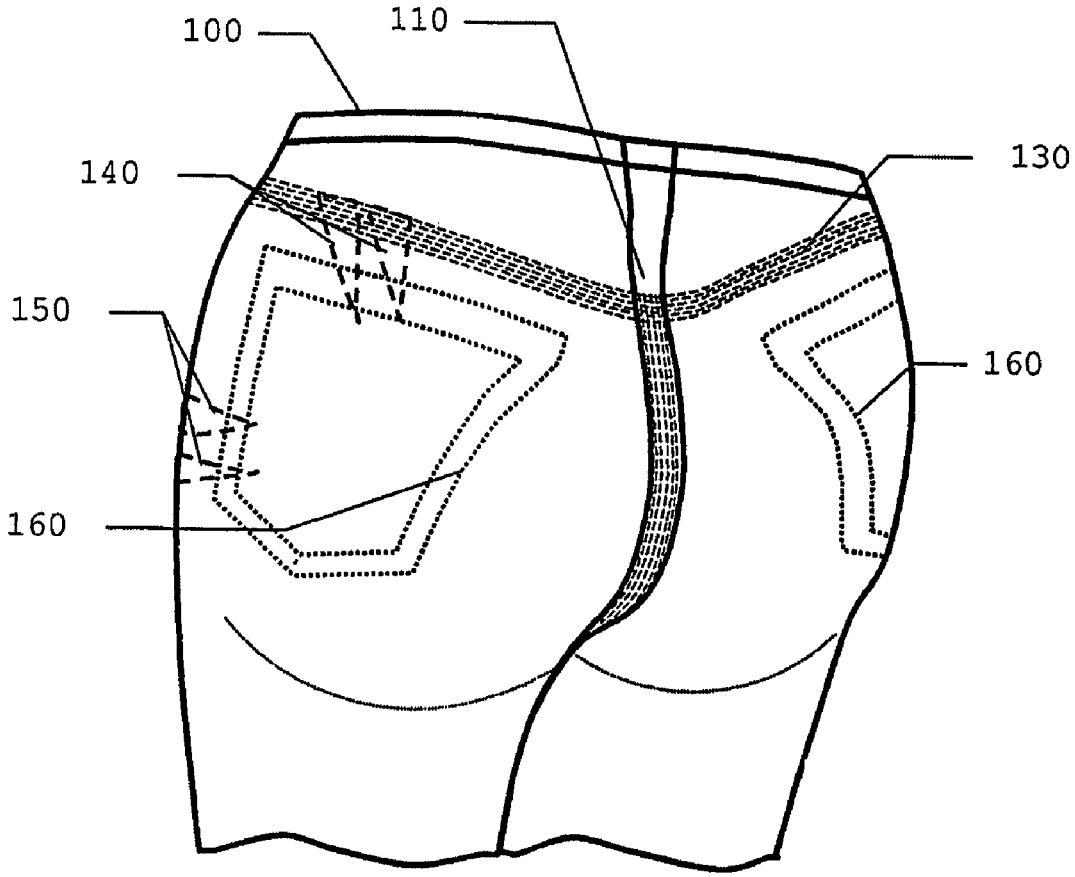
FIG. 3 is a posterior view of a garment being worn by a person and showing the effect of the invention's characteristics.

The combined effect of the crimps (140) and (150) the apparent excess of fabric caused by the excessive curvature in the seam area of the rear sections (110), and the curve of the reinforcement stitch (130) is to produce a 'pouch' of cloth in the garment, precisely in the gluteal region, besides conferring upon the garment a high degree of resistance to deformation in the area around the buttocks, so that the muscle mass and fat is pushed or pressed towards the center of the gluteal region, making it fit into the 'pouch,'thus achieving the desired appearance of the buttocks, as is illustrated schematically in FIG. 3, where the garment of the invention is being worn by a user.

The highly pronounced curved cut (120) also offers an additional free space in the crotch area so that even when the pants as a whole are submitted to a relatively high pressure in the lower part of the user's trunk, due to the stretching of the cloth caused by the pushing of gluteal muscle mass and fat, said pressure is not transferred by the seams to the crotch area, offering more comfort than with conventional cuts of trousers or Bermuda shorts (long or short pants), whether or not they are made to adjust to the user's waist or hip.

In one variation of the garment of the invention, the rear sections are decorated with one or two patch-type pouches, in which the side nearest the seam between the buttocks is curved in shape, as is shown in FIG. 3 by numeral (160), so that it gives a visual effect Of greater roundness.

The invention claimed is:

1. A garment for use on the lower part of a user's body for shaping the user's figure in the region of the buttocks by lifting and holding muscle and fat masses; said garment having four sections correspondening to: front left and front right, and rear left and rear right sections seamed along seam lines, wherein the rear sections:

a. have a reinforcement seam line to adjust to the waist or the hip of the user, describing a first curve surrounding the user's gluteal area, a smaller second curve around a middle portion of the rear section, and a third changing curvature towards a joint line with the right front section, the distance from a top edge of one rear section to the reinforcement seam line being higher in a joint with the other rear section than in a joint with a respective front section;

b. shows an outline along the seam line between rear sections with a greater outward curvature than in conventional pants patterns in both the region at a top of the gluteal area and at a seam line at a crotch portion;

c. have at least one pleat initiated at the reinforcement seam line, seamed to form V-shaped darts in the garment, and extending towards a user's center of the user's buttocks area; and d. have at least one pleat initiated at the seam line with the respective front section of the garment, at a level approximately coincident with an area in which greater curvature of the user's buttocks is desired, and seamed to form V-shaped darts extending toward the center of the user's buttocks area; wherein the four sections are adapted to form a pouch in the garment in the area of the user's buttocks.

2. A garment according to claim 1, wherein the darts extending downwards from the reinforcement seam have vertices inclined towards a center of the pouch.

3. A garment according to claim 1, wherein the darts extending from the seam of the rear section with its front section have vertices inclined towards a center of the pouch.

4. A garment according to claim 1, wherein the upper edge of the garment fits to the user's waist.

5. A garment according to claim 1, wherein the upper edge of the garment fits to the hip of the user.

6. A garment according to claim 1, wherein the rear section have one or two patch-type pockets, each one of the pockets provide a curved outline towards the user's buttocks in a side close to the seam between the user's buttocks.

* * * * *